US007097078B2

(12) United States Patent
Sanchez

(10) Patent No.: US 7,097,078 B2
(45) Date of Patent: Aug. 29, 2006

(54) DISPENSING CAP WITH A PORTABLE CANNULA, DESIGNED FOR FITTING ONTO A PACKAGING AND DISPENSING DEVICE

(75) Inventor: Marcel Sanchez, Aulnay-sous-Bois (FR)

(73) Assignee: L'Oreal, Paris (FR)

( * ) Notice: Subject to any disclaimer, the term of this patent is extended or adjusted under 35 U.S.C. 154(b) by 396 days.

(21) Appl. No.: 10/379,083

(22) Filed: Mar. 5, 2003

(65) Prior Publication Data

US 2003/0168476 A1 Sep. 11, 2003

(30) Foreign Application Priority Data

Mar. 5, 2002 (FR) ..... 0202773

(51) Int. Cl.
*B65D 83/00* (2006.01)

(52) U.S. Cl. ..... 222/402.21; 222/556

(58) Field of Classification Search ..... 222/402.21, 222/402.11, 536, 548, 553, 556
See application file for complete search history.

(56) References Cited

U.S. PATENT DOCUMENTS

| | | | | |
|---|---|---|---|---|
| 1,537,399 A | | 5/1925 | Wiswell | |
| 3,116,856 A | | 1/1964 | Prussin et al. | |
| 3,148,806 A | * | 9/1964 | Meshberg | 222/402.11 |
| 3,371,827 A | | 3/1968 | Micallef | |
| 3,610,480 A | | 10/1971 | Lipfert | 222/402.21 |
| 3,680,605 A | * | 8/1972 | Nigro | 141/20 |
| 4,775,081 A | | 10/1988 | Morane | |
| 5,203,841 A | * | 4/1993 | Kitabayashi | 222/402.11 |

FOREIGN PATENT DOCUMENTS

| | | |
|---|---|---|
| EP | 0 245 822 | 11/1987 |
| EP | 0276713 | 8/1988 |
| EP | 0 601 487 | 6/1994 |
| FR | 2 594 808 | 8/1987 |
| JP | 62-208381 | 9/1987 |
| JP | 62-197548 | 12/1987 |
| JP | 1-174070 | 12/1989 |
| JP | 2-81646 | 6/1990 |
| JP | 10-015022 | 1/1998 |

* cited by examiner

*Primary Examiner*—J. Casimer Jacyna
(74) *Attorney, Agent, or Firm*—Oblon, Spivak, McClelland, Maier & Neustadt, P.C.

(57) ABSTRACT

A dispensing cap and a container having a dispensing cap are provided in which the dispensing cap includes first and second parts designed for mounting onto a container. The dispensing cap includes: (a) a first part fitted with an interior output orifice suitable for allowing selective communication with the container interior; and (b) a second part through a conduit extends and which opens at a dispensing outlet. The second part is arranged so that it can rotate on axis Y, which is aligned obliquely to an axis X of the container, in such a way as to move from a closed position at which the second part will seal off the interior output orifice to a dispensing position in which the interior output orifice will communicate with the dispensing outlet by way of the conduit. In addition, the dispensing cap is configured in such a way as to activate a dispensing member provided on the container.

58 Claims, 4 Drawing Sheets

DISPENSING CAP WITH A PORTABLE CANNULA, DESIGNED FOR FITTING ONTO A PACKAGING AND DISPENSING DEVICE

CROSS REFERENCE TO RELATED APPLICATION

This document claims priority to French application number 0202773 filed Mar. 5, 2002, the entire content of which is hereby incorporated by reference.

BACKGROUND OF THE INVENTION

1. Field of the Invention

The invention relates to a dispensing cap and a device for the packaging and dispensing of a substance, for example, cosmetics or skin treatment products. A substance of this kind can be applied in the form of a cream, gel, foam or spray.

2. Discussion of Background

In general, a dispensing cap of the type of the present invention can fit onto a container or package containing the substance to be applied or dispensed, with the container having an open end onto which a dispensing member is fitted. The dispensing member of the container can be a pump or valve onto which is mounted on the dispensing cap. A dispensing cap of this sort allows the user to direct the substance from the container towards or through a dispensing orifice. In addition, it can facilitate control of the dispensing member, in order to discharge a dose of the substance from the container.

For certain uses that require relatively precise application, it is not unknown to use a dispensing cap holding a container in which the dispensing orifice is formed at the end of an elongated component, such as a cannula. FR Patent 2 594 808 describes an example of an aerosol-type dispenser including a container fitted with a valve, onto which a dispensing cap of this sort is mounted. In addition, the cannula is mobile and can adopt either of two different positions. However, the cannula cannot be moved to adopt a closed position.

U.S. Pat. No. 3,116,856 also describes an example of an aerosol-type dispenser including a container fitted with a valve, onto which a dispensing cap of this type is mounted. According to this arrangement, the dispensing cap includes a first section which is fixed onto the container, and a cannula which is mobile in relation to the first section between a dispensing position and a closed position. When in the dispensing position, in other words when the dispensing orifice can communicate with the interior of the container by activating the valve, the cannula is positioned perpendicular or substantially perpendicular to the container's axis. When in the closed position—in other words, when the dispensing orifice cannot communicate with the container interior—the cannula extends in the direction of the side wall of the container, in other words, parallel or substantially parallel to an axis parallel to that of the container. Hence, to move from the dispensing position to the closed position, the user needs simply to press the cannula along an axis roughly parallel to the container's axis, in such a way as to make the cannula rotate about an axis perpendicular to that of the container.

SUMMARY OF THE INVENTION

It is an object of the invention to provide a new dispensing cap, configured for mounting onto a container on axis X, with the dispensing cap including a first part fitted with an interior outlet orifice capable of selectively communicating with the container interior. The cap further includes a second part through which extends a conduit that opens into a dispensing orifice. This second part is capable of rotating on an axis Y, which is oblique in relation to axis X, in such a way that it will move from a closed position, whereby the second part will seal off the interior output orifice, to a dispensing position in which the interior output orifice allows communication with the dispensing orifice through the conduit. In addition, the dispensing cap is configured so that it will activate a dispensing member fitted onto the container, for example either a pump or valve, so as to connect the interior output orifice of the first part with the container interior.

In order to move from the in use or dispensing position to the closed position, it is thus sufficient to rotate a part of the dispensing cap about axis Y, which is oblique in relation to the container's axis X.

In one exemplary embodiment, the second part—in other words, the mobile section of the dispensing cap—can include a mounting member with an axis Y installed inside the first part such that the mobile part can rotate about its axis Y. The second part may also include a cannula, namely an elongated component, which intersects with or opens into a portion of the conduit, with the cannula opening into a dispensing orifice. The dispensing orifice is preferably provided at the end of a relatively elongated component so that the dispensing cap is capable of dispensing and directing the substance accurately.

The cannula axis can advantageously form an angle other than zero with the axis of the mounting member, usually an angle of approximately 45°. In this way, the cannula will not extend into axis Y on which it rotates, so that it is quite easy, due to its elongated shape, to grasp it and make it rotate about axis Y by having it trace a circular or arcuate movement around axis Y. In one particular version, axis Y forms an angle of approx 45° with axis X of the container.

The cannula may be outside axis X in the dispensing position of the dispensing cap. The dispensing orifice at the open end of the cannula is thus relatively remote from the container's axis, and thus also from the hand of the user holding the container. In this way, the substance emerging from the dispensing orifice is prevented from soiling the user's fingers.

The cannula can be positioned roughly on the axis X in its closed position. Thus, when in this position, the cannula will not increase the lateral size of the packaging and dispensing device that it equips.

According to an exemplary embodiment of the present invention, the mounting member includes a side wall, preferably cylindrically symmetric, featuring at least one orifice which-intersects or communicates with a second section of the conduit. The mounting member is installed so as to rotate inside a cavity provided inside the first part, into which the interior output orifice opens, with the cavity and mounting members having complementary forms. The mounting member is installed inside the cavity in such a way that, when in the position that closes the dispensing cap, its side wall will seal off the interior output orifice, and that, when in the dispensing position, the opening is at least partially opposite the interior output orifice.

The mounting member can be held inside the first part by friction and/or with a snap-fastening. For example a ring-boss can be provided on the outside wall of the mounting member, to cooperate with a ring throat provided on the internal section of the cavity, or the positions of the components can be reversed.

The first part of the dispensing cap can be mounted directly onto the container, which will include fixtures to secure the cap onto the container, for example by screwing, fastening in place, or with a snap-fastening.

By way of example, the second part can be produced by molding a single piece of thermoplastic material. The first part can also be produced by molding a single piece of thermoplastic material.

The invention also relates to a device for the packaging and dispensing of a substance, in particular cosmetic products, including a container having an axis X and a dispensing cap such as that described above.

In the preferred form, the dispensing cap does not protrude beyond the widest transverse section S, according to a plane perpendicular to axis X from the container, when the device is viewed along axis X of the container and when the second part is in the closed position. With this arrangement, when in the closed position, the device has a smaller lateral size, since it is simply restricted to the size of the container itself. Thus, a dispenser of this type is not a bulky item to store. When the second part is in the dispensing position, the dispensing cap can protrude beyond the widest transverse portion S, according to a plane perpendicular to axis X of the container when the device is viewed along the container's axis X.

The device may also include a dispensing member serving the container, fitted with an activating member to which the first part is attached. The dispensing member is made for example from an aerosol-type valve or even a manually-activated pump. In this way, the dispensing cap, and in particular the first part, also serves as a push-button to activate the dispensing member.

The device provided under this invention is particularly useful for the packaging and dispensing of cosmetic or skin-treatment products in the form, for example, of a cream, foam, gel or spray.

BRIEF DESCRIPTION OF THE DRAWINGS

A better appreciation of the invention and many of the attendant advantages thereof will become further apparent from the following detailed description, particularly when read in conjunction with the accompanying drawings in which.

DETAILED DESCRIPTION OF THE PREFERRED EMBODIMENTS

Figure 1:
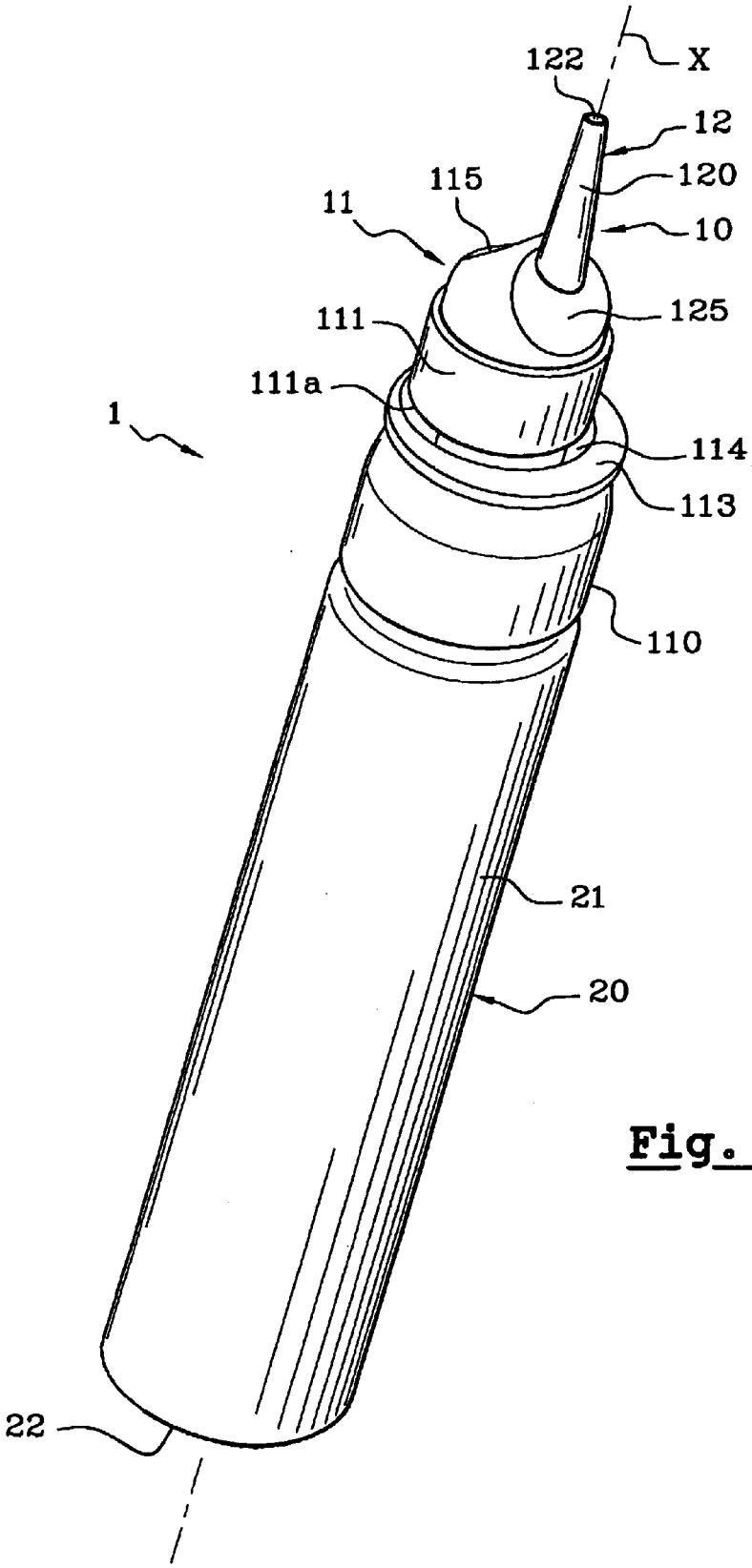
FIG. 1 illustrates a perspective view of one embodiment of a packaging and dispensing device for a substance, capped with a dispensing cap in accordance with the invention.
Figure 2:
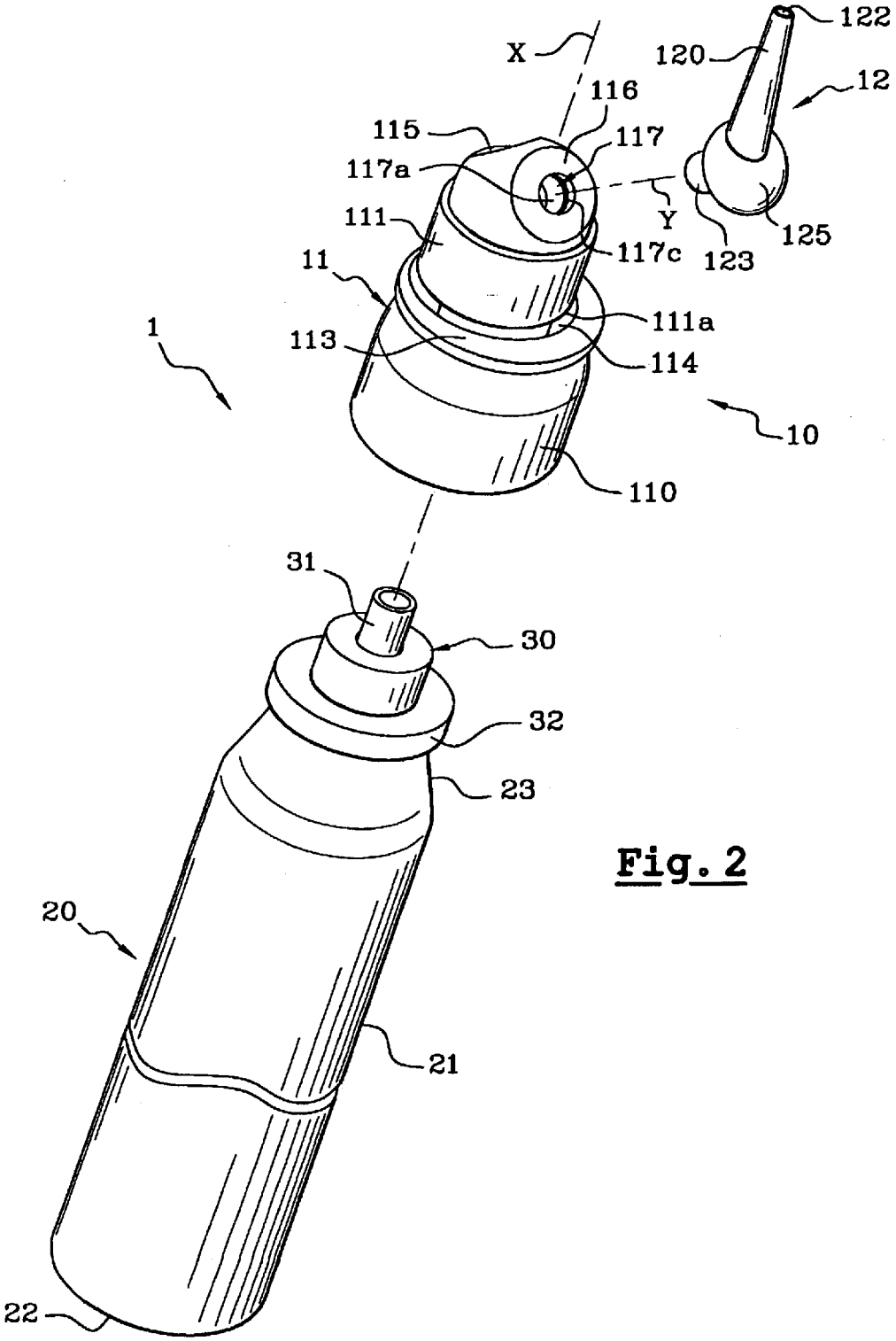
FIG. 2 depicts an exploded view of the device illustrated in FIG. 1.

FIGS. 1 to 4B depict an example of a packaging and dispensing device 1, fitted with a dispensing cap 10 in accordance with the invention.

The device 1 includes a container 20 with an axis X and made, for example, of aluminum. It is to be understood that any other suitable material may be used instead to manufacture the container, such as tin or plastic. The container includes a side wall 21. In the illustrated embodiment, by way of example, the wall 21 is generally cylindrical with a transverse section S (FIGS. 4A and 4B) that is circular and uniform for the greater part of its length. The container is closed off at one end with a base 22. The second end of the container includes a shoulder 23, topped off with an open collar, onto which a dispensing member 30 is secured.

The dispensing member 30, which is not depicted in detail in the illustrations, includes for example an aerosol-type valve such that the container itself can be pressurized. As discussed below, the container is not required to be pressurized as other dispensing arrangements such as a pump could also be utilized. A mounting cup 32, fixed onto the container's open collar, supports an activating member 31. The activating member 31 is a valve shaft which can be activated axially, making it in effect a driving valve, in response to pressure exerted from above. Once activation pressure ceases, a return, for example a spring, restrains the valve shaft in the valve's closed position. In the illustrated embodiment, the valve shaft is disposed roughly along axis X of the container and extends axially beyond the container opening. Alternatively, it is possible to use a valve whose shaft can be activated laterally, such as a toggle valve.

As an alternative, the dispensing member could also be provided in the form of a pump. In this case, the pumping action would generally be produced through pressure exerted axially, which would trigger an axial movement in an activating member. The activating member is attached to a piston, whose movement inside the pump will trigger the release of the substance under pressure in one direction, and in the other direction will trigger the drawing-up of the substance inside the body of the pump. The piston is generally held in the position corresponding to the maximum volume of the pump-chamber by means of a spring.

Figure 3B:
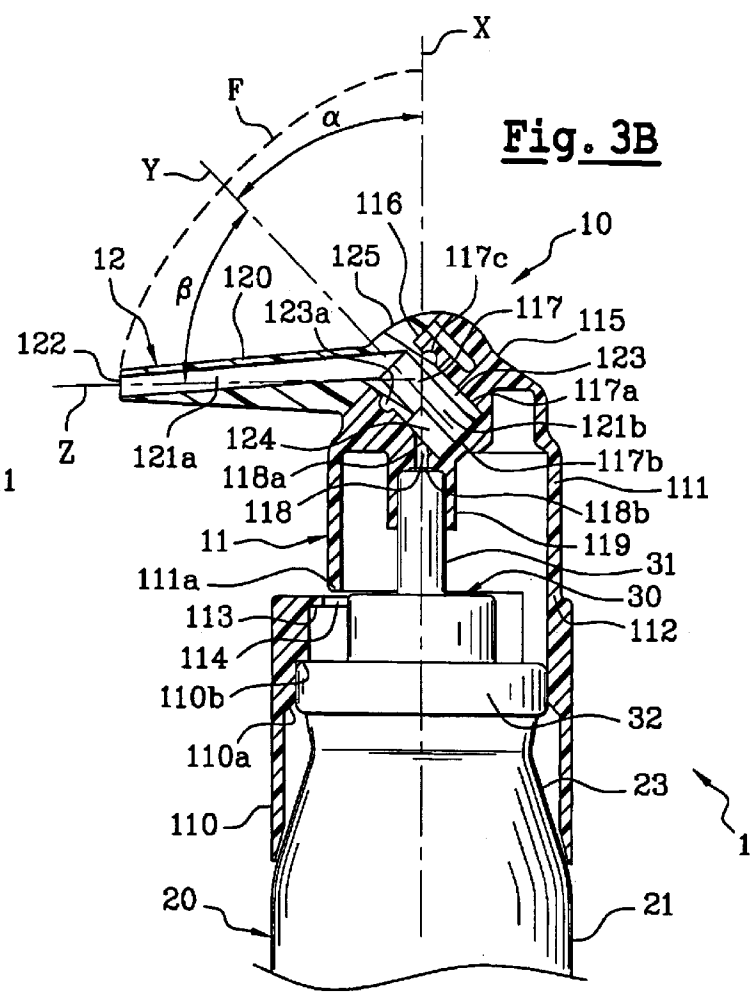
FIG. 3B depicts a longitudinal section of the dispensing cap of the device shown in FIG. 1B, in the dispensing position.
Figure 3A:
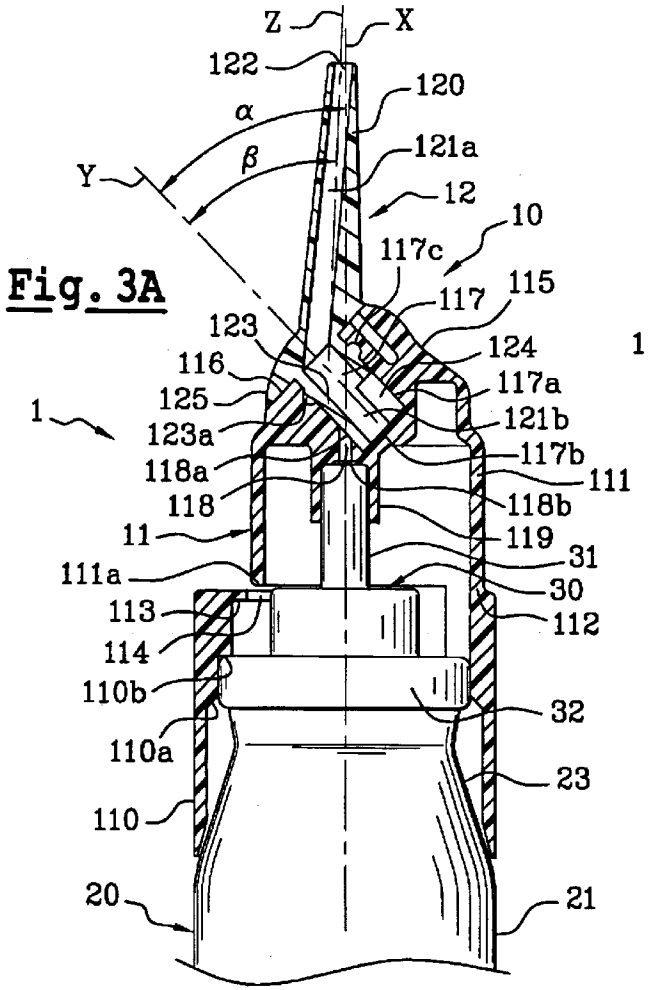
FIG. 3A depicts a longitudinal section of the dispensing cap of the device shown in FIG. 1, in the closed position.

The dispensing the cap 10, depicted in greater detail in FIGS. 3A and 3B, is made essentially from a first part 11, forming a body provided to be fixed onto the container 20, and a second part 12, which is mobile in relation to the body 11.

The body 11 is produced, e.g., by molding a single piece of thermoplastic material, for example polypropylene. The body includes a mounting skirt 110, secured in position, e.g., by screwing the skirt onto the cup 32 of the dispensing-member to unite the dispensing cap and container. A beneficial feature is that the inside wall of the mounting skirt includes a first recess 110*a* which fixes the cup and, on at least one section of its periphery, a second recess 110*b* which comes to a stop flush with the cup 32. This stop 110*b* facilitates the fixing of the dispensing cap onto the container at a precise position, especially to restrict axial thrust of the dispensing cap on the container, and thus preventing activation of the valve shaft while installing the cap in position. In a variant, the inside wall of the mounting skirt can include a protrusion or gadroon, not shown, which stops below the cup 32 in a snap fastening fashion or which is received in a groove, not shown, provided on the wall of the container 20. The skirt 110 caps the upper part of the container at shoulder height, and preferably displays a transverse section roughly the same as that of the rest of the container, so that the external wall of the mounting skirt forms an extension of the container's side wall, without any lateral protrusion.

The upper part of the body 11 of the dispensing cap includes a movable portion to form a push-button. To activate the valve shaft 31, the upper part of the body 11 of the dispensing cap includes a sleeve tube 119, which is fixed onto the valve shaft 31, to which it is attached. The sleeve tube makes it possible to transmit the pressure exerted by the user at the exterior surface of the cap to the valve shaft, in order to drive it down and thus to open the valve.

To facilitate activation of the valve shaft, the upper section of the body can be moved relative to the container, and thus also relative to the skirt, which is fixed in position to the container. To this end, the upper section of the body 11 is connected to the skirt 110 by an intermediate wall 111, cylindrical in revolution. This intermediate wall 111 has a smaller diameter than that of the mounting skirt 110, and is not installed concentrically with the mounting skirt 110. In fact, the wall 111 is produced by an axial extension 112 of a small angular section of the mounting skirt 110, whereas the lower edge 111*a* of the remainder of the wall 111 is free. The angular section 112 thus functions as a hinge, and the free edge 111*a* can penetrate inside the mounting skirt. Advantageously, a transverse flange 113 extends radially from the upper end of the mounting skirt 110, but is not continuous with the intermediate wall 111 so as to leave only one opening 114, which is just sufficient to allow thrust from the push-button, but without forming too large of an opening in the dispensing cap.

In order to accommodate the mobile part 12 of the dispensing cap, the upper part of the body 12 includes a cavity 117. The cavity 117 has a geometric axis Y, which, together with the container's axis X, forms an angle $\alpha$ of approximately 45°. The cavity 117 is delimited by a cylindrical lateral wall 117*a*, which cuts across axis X, and by a base 117*b*. A ring above 117*c*, whose function is discussed below, extends along a trajectory perpendicular to the axis Y inside the side wall 117*a*, and opposite the base 117*b*.

The cavity 117 is designed for communicating with the container interior. To this end, channel 118, made roughly along the container's axis X, opens onto a first end 118*a* in the side wall 117*b* of the cavity 117. The second end 118*b* of the channel 118 opens onto the sleeve tube 119, which is attached to the valve shaft 31. When the dispensing cap drives the valve shaft in response to pressure applied to the dispensing cap, the valve will open up, thus putting the container's interior into communication with the channel 118.

The mobile part 12 of the dispensing cap includes an elongated component 120 formed by a tube or cannula, of a roughly frustoconical form. A first conduit 121 a extends through the cannula 120, and the conduit 121 a opens at one end of the cannula to provide a dispensing orifice 122.

The cannula is installed in the body 11 of the dispensing cap by a mounting member 123, formed by a cylindrical wall produced at the end of the cannula, opposite the dispensing orifice 122. The mounting member 123 and the cavity 117 into which it is inserted have essentially complementary shapes. The cylindrical wall 123 actually forms a watertight contact or seal with the wall of the cavity 117, while allowing the mounting member to rotate around axis Y. A ring-shaped cord 123*a*, made on the outside wall of the mounting member, is provided to be accommodated in the cavity's ring groove 117*c*, so as to hold the mobile part 12 in position inside the body 11 of the cap, but while still allowing the mounting member to rotate around axis Y. The mounting member is crossed by a second conduit 121*b*, which communicates with the first conduit 121 a, which itself crosses the cannula. An orifice 124 is provided on an angular section of the lower part of the wall forming the mounting member 123 such that the orifice can be disposed opposite the interior output orifice 118*a*, which is defined by the end of the channel 118, and which opens into the cavity 117. Hence, in a first position of the mobile part 12, the interior output orifice 118*a* allows communication with the conduit 121 through the orifice 124, and thus also with the dispensing orifice 122. In a second position of the mobile part 12, the interior output orifice 118*a* is sealed by the wall 123 of the mounting member. Alternatively, it can be arranged so that the channel 118 will open out, not into the side wall 117*a* of the mounting member, but instead into its base 117*b*, with the base being partially open so as to produce both a dispensing position and a closed position in cooperation with the mobile part 12.

Cannula 120 has a geometrical axis Z which, together with axis Y, forms an angle $\beta$ approximately equal to 45° with the mounting member, in a plane passing through the orifice 124, approaching the orifice 124. Thus, when in the dispensing position—in other words, when the orifice 124 is opposite the interior output orifice 118*a* formed in the container's axis X—the cannula 120 is roughly perpendicular to the container's X axis. When the cannula is roughly along the container's X axis, the orifice 124 is opposite an area of the wall defining the cavity 117, diametrically opposite the interior output orifice 118*a*, with the result that the interior output orifice 118*a* is opposite the wall 123 of the mounting member.

In the exemplary embodiment of the device described here, the upper section of the body 11 has a largely curved or domed surface, e.g., with a convex external shape or the shape of a segment of a sphere, with this curved surface being interrupted by two essentially flat surfaces.

A first flat surface 116 partially cuts through the dome, following an oblique axis in relation to the container's axis X, in particular following an axis that is perpendicular to axis Y. The cylindrical cavity 117, which accommodates the mounting member of the mobile part 12, opens essentially onto the centre of this surface 116. For its part, the cannula 120 is surrounded at its base, in other words at the side of the mounting member, by a curved surface such as a dome which is a segment of a sphere or hemispherical 125, and whose flat base comes to rest on the flat surface 116 of the body 12. The curvature of the dome 125 is such that it continues the convex or dome shape of the upper section of the body 12.

The convex surface of the upper section of the body is also interrupted by a second essentially flat, or even slightly concave, surface 115, which interrupts another section of the dome on another oblique plane in relation to the container's axis X. This is a preferably continuous surface, whose function is to identify the area on which the user can press to drive the push-button.

Figure 4B:
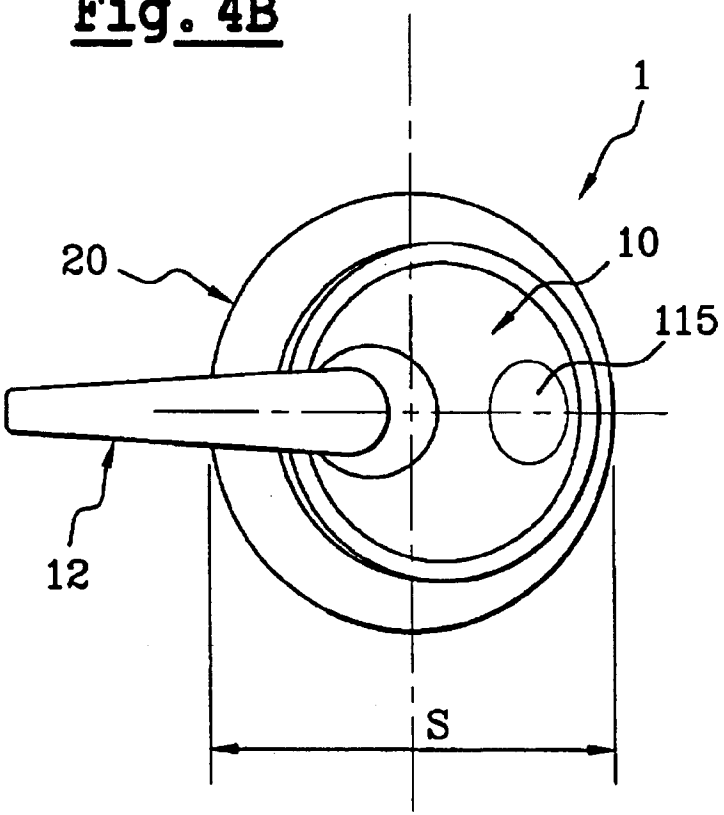
FIG. 4B depicts a view of the device illustrated in FIG. 1 as seen from above, in the dispensing position.
Figure 4A:
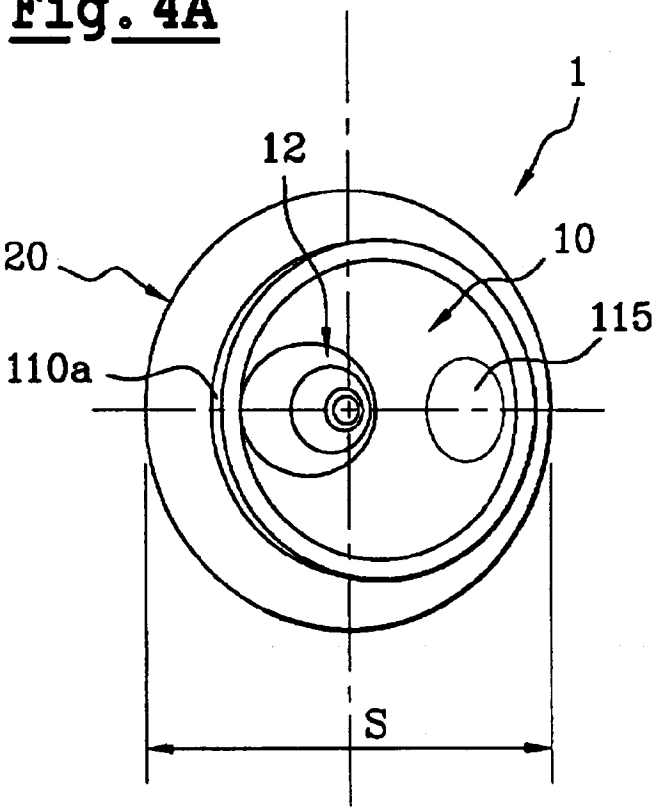
FIG. 4A depicts a view of the device illustrated in FIG. 1 as seen from above, in the closed position.

When in the closed position, the cannula is roughly along the container's X axis, as depicted in FIGS. 3A and 4A, and does not protrude beyond the container's transverse section S. When in this closed position, the dispensing cap can be covered by a removable top, not shown, which will prevent the cannula from rocking.

In order to facilitate use of the device in accordance with the invention, it is possible to pinpoint the two positions that the mobile part 12 can adopt, which correspond firstly to the dispensing position and secondly to the closed position. To this end one could, for example, place a visual marker on the convex surface of the upper section of the body, with which two successive markers of the mobile section 12 could be placed opposite. Placing a first marker opposite to the marker of the body thus corresponds to the dispensing position and placing a second marker opposite to the marker of the body corresponds to the closed position. The markers could be made for example by using different colors, or even by letters that are sufficiently clear to allow the user to identify the dispensing and closed positions.

Alternatively, or additionally, the two positions might be pinpointed mechanically. For example, a pin can be provided on the flat base of the hemispherical cap 125, which would function together with a circular arched groove made on the flat surface 116 of the upper section of the body, with the two ends of the circular arc of the groove corresponding to the two positions of the dispensing cap. In this way, when the mobile part rotates around axis Y, the pin will move inside the groove in a circular arc and will come to a stop at the two ends of the groove.

To use the device 1, the user places the cannula 120 following an axis roughly perpendicular to the container's axis X by making the entire mobile section 12 rotate about axis Y, with the cannula's circular trajectory being indicated by the arrow F on FIG. 3B. In this position, depicted in FIGS. 3B and 4B, the interior output orifice 118*a* allows communication with dispensing orifice 122. Furthermore, when in this position, the cannula protrudes laterally beyond the container's transverse section S, as can be seen in FIG. 4B, with the result that dispensing orifice 122 is relatively remote from the container and the user's hand while he/she is holding the device in order to press on the push-button. The user is then able to drive the push-button by pressing on the surface 115 in order to push in the sleeve tube as well as the valve shaft, this movement being possible by virtue of the fact that the upper section of the dispensing cap rocks around the hinge 112, and that the free edge 111*a* of the intermediate wall 11 is able to thrust into the interior of the mounting skirt 110. The valve then opens, allowing discharge of the pressurized substance in the container from the container (or alternatively, as discussed earlier, with a pumping action). The substance is then dispensed through the dispensing orifice via the channel 118 and the conduits 121*a* and 121*b*.

Obviously, numerous modifications and variations of the present invention are possible in light of the above teachings. It is therefore to be understood that, within the scope of the appended claims, the invention may be practiced otherwise than as specifically described herein.

What is claimed is:

1. A dispensing cap intended for mounting onto a container having an axis X, the dispensing cap including:

(a) a first part having an interior output orifice suitable for selectively communicating with an interior of a container, wherein said first part includes a movable portion and a skirt, and wherein said movable portion is movable relative to said skirt;

(b) a second part through which a conduit extends, the conduit opening into a dispensing orifice, and wherein the second part is rotatable about an axis Y which is oblique to axis X so as to move from a closed position to a dispensing position, wherein in said closed position the second part seals off the interior output orifice of the first part, and wherein in said dispensing position, the interior output orifice can communicate with the dispensing orifice by way of the conduit; and wherein the dispensing cap is configured to activate a dispensing member provided on a container.

2. A dispensing cap according to claim 1, wherein the second part includes a mounting member disposed on axis Y, with the mounting member installed in the first part to rotate about axis Y.

3. A dispensing cap according to claim 2, wherein the second part includes a cannula through which extends a first section of the conduit that opens into the dispensing orifice.

4. A dispensing cap according to claim 3, wherein the cannula has an axis which forms a non-zero angle with an axis of the mounting member.

5. A dispensing device according to claim 4, wherein the angle between the axis of the cannula and the axis of the mounting member is approximately 45°.

6. A dispensing cap according to claim 1, wherein the second part includes a cannula through which extends a section of the conduit that opens into the dispensing orifice.

7. A dispensing cap according to claim 1, wherein the axis Y forms an angle of approximately 45° with the axis X.

8. A dispensing cap according to any of claim 3, wherein when the second part is in the dispensing position, the cannula does not extend along the axis X.

9. A dispensing device according to claim 8, wherein the cannula extends in a direction substantially perpendicular to the axis X when the second part is in the dispensing position.

10. A dispensing cap according to any of claim 5, wherein when the second part is in the dispensing position, the cannula does not extend along the axis X.

11. A dispensing cap according to claim 3, wherein the mounting member includes a side wall having at least one orifice, and wherein a second section of the conduit extends through said mounting member, and wherein said mounting member is installed to rotate inside a cavity provided in the first part, and further wherein the interior output orifice opens into said cavity.

12. A dispensing cap according to claim 1, wherein the first part includes a securing element to fix the dispensing cap onto the container.

13. A dispensing cap according to claim 1, wherein said second part includes a mounting member installed in the first part, and wherein the mounting member includes an orifice through which said interior output orifice communicates with said conduit in the dispensing position, and wherein the orifice of the mounting member is not in communication with said interior output orifice in said closed position.

14. A dispensing cap according to claim 1, wherein the second part is a molded one piece part formed of a thermoplastic material.

15. A dispensing cap according to claim 1, wherein the first part is a molded one piece part formed of a thermoplastic material.

16. A device according to claim 1, further including a container having an axis X and wherein said dispensing cap is mounted to said container.

17. A device according to claim 16, wherein when viewed along the axis X and the second part is in the closed position, the dispensing cap does not protrude beyond a widest transverse section S of the container in a plane perpendicular to the axis X.

18. A device according to claim 17, wherein when viewed along the axis X and the second part is in the dispensing position, the dispensing cap protrudes beyond the widest transverse section S of the container.

19. A device according to claim 16, wherein when viewed along the axis X and when the second part is in the dispensing position, the dispensing cap protrudes beyond a widest transverse section S of the container in a plane perpendicular to the axis X.

20. A device according to claim 16, wherein the container includes a dispensing arrangement having at least one activating member for selectively opening and closing the dispensing arrangement, and wherein the first part is coupled to the activating member.

21. A device according to claim 20, wherein the dispensing arrangement includes an aerosol-type valve.

22. A device according to claim 20, wherein the dispensing arrangement includes a manually-activated pump.

23. A device according to claim 16, further including one of a cosmetic product and a skin treatment product disposed in said container.

24. A device according to claim 23, wherein the one of a cosmetic product and a skin treatment product is dispensed as one of a cream, a foam, a gel and a spray.

25. A dispensing cap as recited in claim 6, wherein said second part includes a domed surface and wherein said cannula extends from the domed surface.

26. A dispensing cap as recited in claim 25, wherein a portion of said first part is curved to provide a dome extension of the domed surface of the second part in at least one of the dispensing position and the closed position.

27. A dispensing cap as recited in claim 26, wherein said cannula extends upright in said closed position and said cannula extends laterally in said dispensing position.

28. A dispensing cap as recited in claim 6, wherein said cannula extends upright in said closed position and said cannula extends laterally in said dispensing position.

29. A dispensing cap according to claim 6, wherein said cannula has a frusto-conical shape.

30. A dispensing cap intended for mounting onto a container having an axis X, the dispensing cap including:

(a) a first part having an interior output orifice suitable for selectively communicating with an interior of a container;

(b) a second part through which a conduit extends, the conduit opening into a dispensing orifice, and wherein the second part is rotatable about an axis Y which is oblique to axis X so as to move from a closed position to a dispensing position, wherein in said closed position the second part seals off the interior output orifice of the first part, and wherein in said dispensing position, the interior output orifice can communicate with the dispensing orifice by way of the conduit;

wherein the dispensing cap is configured to activate a dispensing member provided on a container;

wherein the second part includes a mounting member disposed on axis Y, with the mounting member installed in the first part to rotate about axis Y;

wherein the second part includes a cannula through which extends a first section of the conduit that opens into the dispensing orifice; and wherein when the second part is in the closed position, the cannula extends substantially along the axis X.

31. A dispensing cap intended for mounting onto a container having an axis X, the dispensing cap including:

(a) a first part having an interior output orifice suitable for selectively communicating with an interior of a container;

(b) a second part through which a conduit extends, the conduit opening into a dispensing orifice, and wherein the second part is rotatable about an axis Y which is oblique to axis X so as to move from a closed position to a dispensing position, wherein in said closed position the second part seals off the interior output orifice of the first part, and wherein in said dispensing position, the interior output orifice can communicate with the dispensing orifice by way of the conduit;

wherein the dispensing cap is configured to activate a dispensing member provided on a container;

wherein the axis Y forms an angle of approximately 45° with the axis X; and wherein when the second part is in the closed position, the cannula extends in a direction substantially parallel to the axis X.

32. A dispensing cap intended for mounting onto a container having an axis X, the dispensing cap including:

(a) a first part having an interior output orifice suitable for selectively communicating with an interior of a container;

(b) a second part through which a conduit extends, the conduit opening into a dispensing orifice, and wherein the second part is rotatable about an axis Y which is oblique to axis X so as to move from a closed position to a dispensing position, wherein in said closed position the second part seals off the interior output orifice of the first part, and wherein in said dispensing position, the interior output orifice can communicate with the dispensing orifice by way of the conduit;

wherein the dispensing cap is configured to activate a dispensing member provided on a container;

wherein the second part includes a mounting member disposed on axis Y, with the mounting member installed in the first part to rotate about axis Y;

wherein the second part includes a cannula through which extends a first section of the conduit that opens into the dispensing orifice;

wherein the mounting member includes a side wall having at least one orifice, and wherein a second section of the conduit extends through said mounting member, and wherein said mounting member is installed to rotate inside a cavity provided in the first part, and further wherein the interior output orifice opens into said cavity; and wherein the mounting member is installed inside the cavity such that, when in the closed position, the side wall provides a fluid-tight seal of the interior output orifice, and such that, when in the dispensing position, the at least one orifice of the mounting member is at least partially opposite the interior output orifice.

33. A dispensing cap intended for mounting onto a container having an axis X, the dispensing cap including:

(a) a first part having an interior output orifice suitable for selectively communicating with an interior of a container;

(b) a second part through which a conduit extends, the conduit opening into a dispensing orifice, and wherein the second part is rotatable about an axis Y which is oblique to axis X so as to move from a closed position to a dispensing position, wherein in said closed position the second part seals off the interior output orifice of the first part, and wherein in said dispensing position, the interior output orifice can communicate with the dispensing orifice by way of the conduit;

wherein the dispensing cap is configured to activate a dispensing member provided on container;

wherein the second part includes a mounting member disposed on axis Y, with the mounting member installed in the first part to rotate about axis Y; and wherein the mounting member is held inside the first part by friction.

34. A dispensing cap intended for mounting onto a container having an axis X, the dispensing cap including:

(a) a first part having an interior output orifice suitable for selectively communicating with an interior of a container;

(b) a second part through which a conduit extends, the conduit opening into a dispensing orifice, and wherein the second part is rotatable about an axis Y which is oblique to axis X so as to move from a closed position to a dispensing position, wherein in said closed position the second part seals off the interior output orifice of the first part, and wherein in said dispensing position, the interior output orifice cap communicate with the dispensing orifice by way of the conduit;

wherein the dispensing cap is configured to activate a dispensing member provided on a container;

wherein the second part includes a mounting member disposed on axis Y, with the mounting member installed in the first part to rotate about axis Y; and wherein the mounting member is held inside the first part by a snap fastening.

35. An assembly for dispensing a product, the assembly including a dispensing cap, the dispensing cap including:

(a) a first part having an interior output orifice suitable for selectively communicating with an interior of a container;

(b) a second part through which a conduit extends, the conduit opening into a dispensing orifice, and wherein the second part is rotatable about an axis Y which is oblique to axis X so as to move from a closed position to a dispensing position, wherein in said closed position the second part seals off the interior output orifice of the first part, and wherein in said dispensing position, the interior output orifice can communicate with the dispensing orifice by way of the conduit;

wherein the dispensing cap is configured to activate a dispensing member provided on a container; and the assembly further including a container having an axis X, wherein said dispensing cap is mounted to said container, and wherein said first part includes a movable portion and a skirt, and wherein said movable portion is movable relative to said skirt.

36. An assembly according to claim 35, wherein a center of said movable part is offset from the axis X of the container.

37. An assembly according to claim 36, wherein said second part includes a cannula which terminates at said dispensing orifice, and wherein at least a portion of said cannula intersects with the axis X when the second part is in the closed position.

38. An assembly for dispensing a product, the assembly including a dispensing cap comprising:

(a) a first part having an interior output orifice for selectively communicating with a container, said first part including a sleeve which receives a valve shaft of a container and a channel extending to said interior output orifice such that said interior output orifice is in communication with said valve shaft;

(b) a second part through which a conduit extends, said second part including a mounting member and a cannula and wherein a first section of said conduit extends through said cannula and said cannula opens into a dispensing orifice, wherein the mounting member is rotatably received in said first part, and wherein said cannula extends at an oblique angle with respect to said mounting member, and wherein said second part is movable between a dispensing position and a closed position by way of the mounting member being rotatably received in the first part, and wherein in said dispensing position said conduit of said second part is in communication with said interior output orifice and in said closed position said conduit is not in communication with said interior output orifice; and wherein the dispensing cap is configured to activate a dispensing member provided on a container.

39. An assembly as recited in claim 38, wherein said first part includes a first substantially planar surface and said second part includes a second substantially planar surface facing said first substantially planar surface, and wherein during movement of said second part the second substantially planar surface is rotated relative to the first substantially planar surface, and further wherein said cannula extends at an oblique angle with respect to a plane of said second substantially planar surface.

40. An assembly as recited in claim 38, wherein in said dispensing position the interior output orifice communicates with an opening in said mounting member of said second part and in said closed position a portion of said mounting member closes off the interior output orifice.

41. An assembly as recited in claim 38, wherein said mounting member includes a side wall having at least one orifice, and wherein a second section of said conduit extends through said mounting member.

42. An assembly as recited in claim 41, wherein the side wall provides a fluid-tight seal of the interior output orifice in the closed position, and in the dispensing position the at least one orifice of the mounting member is in communication with the interior output orifice.

43. An assembly according to claim 42, further including a container having an axis X, wherein in said closed position said cannula extends in a direction substantially parallel to said axis X.

44. An assembly according to claim 38, further including a container having an axis X, wherein in said closed position said cannula extends in a direction substantially parallel to said axis X.

45. An assembly as recited in claim 38, wherein said cannula has a frusto-conical shape.

46. An assembly as recited in claim 38, wherein said second part includes a domed surface, and wherein said cannula extends from said domed surface.

47. An assembly for dispensing a product, the assembly including a dispensing cap comprising:

(a) a first part having an interior output orifice for selectively communicating with a container;

(b) a second part through which a conduit extends, said second part including a mounting member and a cannula, wherein the mounting member is rotatably received in said first part, and wherein said cannula extends at an oblique angle with respect to said mounting member, and wherein said second part is movable between a dispensing position and a closed position by way of the mounting member being rotatably received in the first part, and wherein in said dispensing position said conduit of said second part is in communication with said interior output orifice and in said closed position said conduit is not in communication with said interior output orifice;

wherein the dispensing cap is configured to activate a dispensing member provided on a container;

wherein said first part includes a first substantially planar surface and said second part includes a second substantially planar surface facing said first substantially planar surface, and wherein during movement of said second part the second substantially planar surface is rotated relative to the first substantially planar surface, and further wherein said cannula extends at an oblique angle with respect to a plane of said second substantially planar surface; and wherein said second part includes a domed surface and wherein said cannula extends from the domed surface.

48. An assembly as recited in claim 47, wherein a portion of said first part is curved to provide a dome extension of the domed surface of the second part in at least one of the dispensing position and the closed position.

49. An assembly as recited in claim 48, wherein said cannula extends upright in said closed position and said cannula extends laterally in said dispensing position.

50. An assembly as recited in claim 49, further including a container having an axis X, wherein said dispensing cap is mounted on said container, and wherein said second part rotates about an axis Y which is oblique to said axis X.

51. An assembly as recited in claim 50, wherein said container includes a cross-section S in a plane perpendicular to the axis X, and wherein when viewed in a direction along axis X, the second part does not protrude beyond the cross-section S when in the closed position.

52. An assembly as recited in claim 51, wherein when viewed in a direction along axis X, the second part protrudes beyond the cross-section S when in the dispensing position.

53. An assembly as recited in claim 52, wherein the first part includes a movable portion and the container includes a dispensing member having an activating member, and wherein said movable portion is coupled to the activating member of said container, and wherein movement of said movable portion causes movement of said activating member to dispense a product from said container when said second part is in said dispensing position.

54. An assembly as recited in claim 53, wherein said first part includes a skirt coupled to said container, and wherein said movable portion of said first part is movable relative to said skirt.

55. An assembly as recited in claim 54, wherein said mounting member of said second part is rotatably received in said movable portion of said first part.

56. An assembly for dispensing a product, the assembly including a dispensing cap comprising:

(a) a first part having an interior output orifice for selectively communicating with a container;

(b) a second part through which a conduit extends, said second part including a mounting member and a cannula, wherein the mounting member is rotatably received in said first part, and wherein said cannula extends at an oblique angle with respect to said mounting member, and wherein said second part is movable between a dispensing position and a closed position by way of the mounting member being rotatably received in the first part, and wherein in said dispensing position said conduit of said second part is in communication with said interior output orifice and in said closed position said conduit is not in communication with said interior output orifice;

wherein the dispensing cap is configured to activate a dispensing member provided on a container; and wherein said first part includes a movable portion and a skirt, wherein said movable portion is movable relative to said skirt.

57. An assembly as recited in claim 56, wherein said assembly includes a container having an axis X, and wherein a center of said movable part is offset from the axis X of the container.

58. An assembly as recited in claim 57, wherein at least a portion of said cannula intersects with the axis X when the second part is in the closed position.

* * * * *